US006142206A

United States Patent [19]

Ryan

[11] Patent Number: 6,142,206

[45] Date of Patent: Nov. 7, 2000

[54] LAP SPLICING APPARATUS WITH THE TRAILING TAIL END OF THE SPLICE ALWAYS ON THE SAME SIDE

[75] Inventor: Ralph L. Ryan, East Hanover, N.J.

[73] Assignee: CTC International Inc., West Caldwell, N.J.

[21] Appl. No.: 09/120,428

[22] Filed: Jul. 22, 1998

[51] Int. Cl.[7] ..... B65H 21/00

[52] U.S. Cl. ..... 156/504; 156/502; 156/505; 156/159; 242/553; 242/555.1

[58] Field of Search ..... 156/157, 159, 156/502, 504, 505; 242/552, 553, 555.1, 556.1, 555.6

[56] References Cited

U.S. PATENT DOCUMENTS

| | | | |
|---|---|---|---|
| 3,730,811 | 5/1973 | Wendt | 156/505 X |
| 4,219,378 | 8/1980 | Marschke . | |
| 4,386,988 | 6/1983 | Kontz | 156/157 |
| 4,455,190 | 6/1984 | Bianchetto et al. . | |
| 4,738,739 | 4/1988 | Schoonderbeek . | |
| 5,066,345 | 11/1991 | Long et al. . | |
| 5,443,681 | 8/1995 | Stivani et al. . | |
| 5,669,998 | 9/1997 | Ward et al. . | |
| 5,676,792 | 10/1997 | Cairns . | |
| 5,679,207 | 10/1997 | Palone et al. . | |
| 5,849,123 | 12/1998 | Rice | 156/157 X |

*Primary Examiner*—Mark A. Osele
*Attorney, Agent, or Firm*—Richard M. Goldberg

[57] ABSTRACT

A lap splicing apparatus for lap splicing first and second webs together, with each of the first and second webs alternately constituting a running web and a new web to be spliced to the running web, includes a frame; a first spindle mounted at a first fixed position on the frame for holding a roll containing the first web at a first orientation; a second spindle mounted at a second fixed position on the frame for holding a roll containing the second web at the first orientation; a single lap splicing device immovably mounted at a fixed position on the frame for lap splicing the first and second webs together with the trailing tail end of the lap splice always being on the same side; a first transfer assembly of rollers for bringing the first web to the lap splicing device, and for turning the first web by at least one angle from the first orientation; and second transfer assembly of rollers for bringing the second web to the lap splicing device, and for turning the second web by at least one angle from the first orientation, such that the running web is at a first level and the new web is at a different, second level prior to the lap splicing operation, with the new web moving from the second level to the first level after the lap splicing operation.

31 Claims, 6 Drawing Sheets

LAP SPLICING APPARATUS WITH THE TRAILING TAIL END OF THE SPLICE ALWAYS ON THE SAME SIDE

BACKGROUND OF THE INVENTION

The present invention relates generally to apparatus for splicing webs of material together, and more particularly, is directed to a lap splicing apparatus in which the trailing tail end of the splice is always on the same side without using any turret assembly for holding the rolls of web material.

In web transport machines, when a running web nears depletion, it is necessary to splice the trailing end of the running web to the leading end of a new web. There are different types of web splices. Specifically, there is a butt splice in which the ends of the webs are accurately butted together in end to end relationship. The other type of splice is a lap splice in which the leading end of the new web has a piece of double-sided tape and the opposite side of the tape is adhered to the running web at a position offset from the trailing edge thereof. As a result, there is a tail at the trailing end of the running web which overlaps the leading end of the new web.

However, if the two rolls, that is, the roll nearing depletion and the new roll, are fixed in position on spindles, and are then spliced together, the overlying tail of the running web will be on alternate sides of the spliced web during sequential splicing operations. Many end users do not like this arrangement since it may cause problems with the machinery downstream of the splicing assembly. Specifically, the leading edge of the new web on the side opposite from the tail can be caught in a mechanism downstream, which results in the machine being shut down, and the entire line of web material, which can be very long, being rethreaded in the machine. Therefore, many end users require the trailing tail end of the splice to be on the same side at all times.

In order to accomplish this, a turret assembly has generally be provided for holding the two rolls of web material. In such case, the new roll is always indexed to the same position during the splicing operation so that the trailing tail end of the lap splice occurs on the same side at all times. However, this results in additional space being taken up and more complicated machinery.

OBJECTS AND SUMMARY OF THE INVENTION

Accordingly, it is an object of the present invention to provide a lap splicing apparatus that overcomes the aforementioned problems with the prior art.

It is another object of the present invention to provide a lap splicing apparatus in which the trailing tail end of the lap splice is provided on the same side at all times, without requiring any turret to reposition the rolls.

It is still another object of the present invention to provide a lap splicing apparatus in which the spindles for holding the rolls of web material are fixed in position and the device for performing the lap splicing is also mounted in a fixed position on a frame.

It is yet another object of the present invention to provide a lap splicing apparatus in which the webs are rotated by successive 90° angles from their original orientation between the roll mounting spindles and the single lap splicing device such that the trailing tail end of the lap splice occurs on the same side at all times.

It is a further object of the present invention to provide a lap splicing apparatus in which the lap splicing device permits the running web to pass therethrough at a first level and holds the leading end of the new web at a different, second level spaced above the running web when no lap splicing is being performed, with the second level remaining the same regardless of whether the running web is the first web or the second web, and then cuts the running web and brings the new web into lap splicing contact with the running web during a lap splicing operation.

It is a still further object of the present invention to provide a lap splicing apparatus which is easy and economical to use and manufacture.

In accordance with an aspect of the present invention, a lap splicing apparatus is provided for lap splicing first and second webs together, with each of the first and second webs alternately constituting a running web and a new web to be spliced to the running web. The apparatus includes a frame; a first spindle mounted at a first fixed position on the frame for holding a roll containing the first web thereon; and a second spindle mounted at a second fixed position on the frame for holding a roll containing the second web thereon. A single lap splicing device is immovably mounted at a fixed position on the frame for lap splicing the first and second webs together with the trailing tail end of the lap splice always being on the same side. A first transfer assembly mounted to the frame for bringing the first web to the lap splicing device; and a second transfer assembly mounted to the frame for bringing the second web to the lap splicing device.

The single lap splicing device permits the running web to pass therethrough at a first level and includes a lap splicing device frame; a holding device for holding a leading end of the new web; a moving device at a fixed position on the lap splicing device frame for moving the holding device between a first lap splicing position and a second position at which no lap splicing occurs, with the new web being held at a different, second level spaced from the running web in the second position such that the second level remains the same regardless of whether the running web is the first web or the second web; and a cutting device for cutting the running web when the moving device moves the holding device to the first position to bring the new web into lap splicing contact with the running web during a lap splicing operation such that adhesive tape on the leading end of the new web adheres to the cut running web to lap splice the new web and the running web together, with the trailing tail end of the lap splice always being on the same side.

The holding device includes a pressure plate having a plurality of vacuum holes extending to an underside thereof, and a manifold for fluidly connecting a vacuum source with the vacuum holes to hold the new web to the underside of the pressure plate. The lap splicing device further includes a splice block, and a clamping device for clamping the running web to the splice block to prevent movement thereof at the time of a lap splicing operation. The clamping device includes a clamp stud slidably extending through the pressure plate and having a clamp pad at a lower end thereof for clamping the running web to the splice block. The clamping device further includes a coil spring surrounding the clamp stud and positioned between the clamp pad and the pressure plate to bias the clamp pad in a direction toward the splice block.

The moving device includes a cylinder fixed to the lap splicing device frame; and at least one rod which is extendable and retractable by the cylinder and connected to the holding device for moving the holding device toward and away from the running web. The lap splicing device frame includes a pivotal cover, and the cylinder is fixed to the cover to permit access to the holding device.

The cutting device includes a knife blade pivotally mounted upstream of the holding device between a first pivoted position above the running web and a second pivoted position below the running web, such that the knife blade cuts the running web when moved from the first position to the second position; an arrangement for holding the knife blade stably in the first position or the second position; and a second moving device for moving the knife blade transverse relative to the first moving device between a first transverse position in line with the running web and a second transverse position out of line with the running web. The holding device impacts upon the knife blade when moving from the first position to the second position thereof to move the knife blade from the first pivoted position to the second pivoted position in order to cut the running web and thereby position the knife blade below the running web, and after the knife blade returns to the first pivoted position thereafter, the second moving assembly moves the knife blade to the second transverse position so that the spliced new web can assume the position of the previous running web. The arrangement for stably holding the knife blade in the first pivoted position includes a stop pin.

In accordance with another aspect of the present invention, a lap splicing apparatus is provided for lap splicing first and second webs together, with each of the first and second webs alternately constituting a running web and a new web to be spliced to the running web. The apparatus includes a frame; a first spindle mounted at a first fixed position on the frame for holding a first roll containing the first web thereon, such that the first web leaves the first roll at a first orientation; and a second spindle mounted at a second fixed position on the frame for holding a second roll containing the second web thereon, such that the second web leaves the second roll at the first orientation. A single lap splicing device is mounted on the frame for lap splicing the first and second webs together with the trailing tail end of the lap splice always being on the same side. A first transfer assembly of rollers is mounted to the frame for bringing the first web to the lap splicing device, the rollers of the first transfer assembly being oriented to turn the first web by at least one angle from the first orientation such that the first web is at a first level when constituting the running web and at a different, second level when constituting the new web prior to a lap splicing operation, with the new web moving from the second level to the first level after a lap splicing operation. A second transfer assembly of rollers is mounted to the frame for bringing the second web to the lap splicing device, the rollers of the second transfer assembly being oriented to turn the second web by at least one angle from the first orientation such that the second web is at the first level when constituting the running web and at the second level when constituting the new web prior to the lap splicing operation, with the new web moving from the second level to the first level after the lap splicing operation.

The first and second spindles are mounted along first and second axes. The first transfer assembly includes a first guide roller having an axis substantially transverse to the axis of the first spindle for rotating the orientation of the first web by substantially 90° from the first orientation to a second orientation, and the lap splicing device rotates the first web back to the first orientation. In like manner, the second transfer assembly includes a second guide roller mounted to the frame and having an axis substantially transverse to the axis of the second spindle for rotating the orientation of the second web by substantially 90° from the first orientation to the second orientation; and the lap splice device changes the orientation of the second web back to the first orientation.

The first transfer assembly includes another guide roller having an axis substantially parallel to the axis of the first guide roller and interposed between the first guide roller and the lap splicing device to maintain the orientation of the first web at the second orientation, but to change the direction of movement of the first web. There is also a downstream guide roller having an axis substantially parallel to the axes of the first and second spindles and interposed between the first and second transfer assemblies and the lap splicing device to guide the webs in the first orientation.

Preferably, the axis of the first and second spindles are horizontal axes and the first orientation is a substantially horizontal orientation, and the axis of the first and second guide rollers are substantially vertical axes and the orientation of the web at the first and second guide rollers is a substantially vertical orientation.

In accordance with still another aspect of the present invention, a lap splicing apparatus is provided for lap splicing first and second webs together, with each of the first and second webs alternately constituting a running web and a new web to be spliced to the running web. The apparatus includes a frame; a first spindle mounted at a first fixed position on the frame for holding a roll containing the first web thereon, such that the first web leaves the first roll at a first orientation; and a second spindle mounted at a second fixed position on the frame for holding a roll containing the second web thereon, such that the second web leaves the second roll at the first orientation. A single lap splicing device is immovably mounted at a fixed position on the frame for lap splicing the first and second webs together with the trailing tail end of the lap splice always being on the same side. A first transfer assembly of rollers is mounted to the frame for bringing the first web to the lap splicing device, the rollers of the first transfer assembly being oriented to turn the first web by at least one angle from the first orientation such that the first web is at a first level when constituting the running web and at a different, second level when constituting the new web prior to a lap splicing operation, with the new web moving from the second level to the first level after a lap splicing operation. A second transfer assembly of rollers is mounted to the frame for bringing the second web to the lap splicing device, the rollers of the second transfer assembly being oriented to turn the second web by at least one angle from the first orientation such that the second web is at the first level when constituting the running web and at the second level when constituting the new web prior to the lap splicing operation, with the new web moving from the second level to the first level after the lap splicing operation.

The above and other objects, features and advantages of the present invention will become readily apparent from the following detailed description which is to be read in conjunction with the accompanying drawings.

DETAILED DESCRIPTION OF A PREFERRED EMBODIMENT

Figure 1:
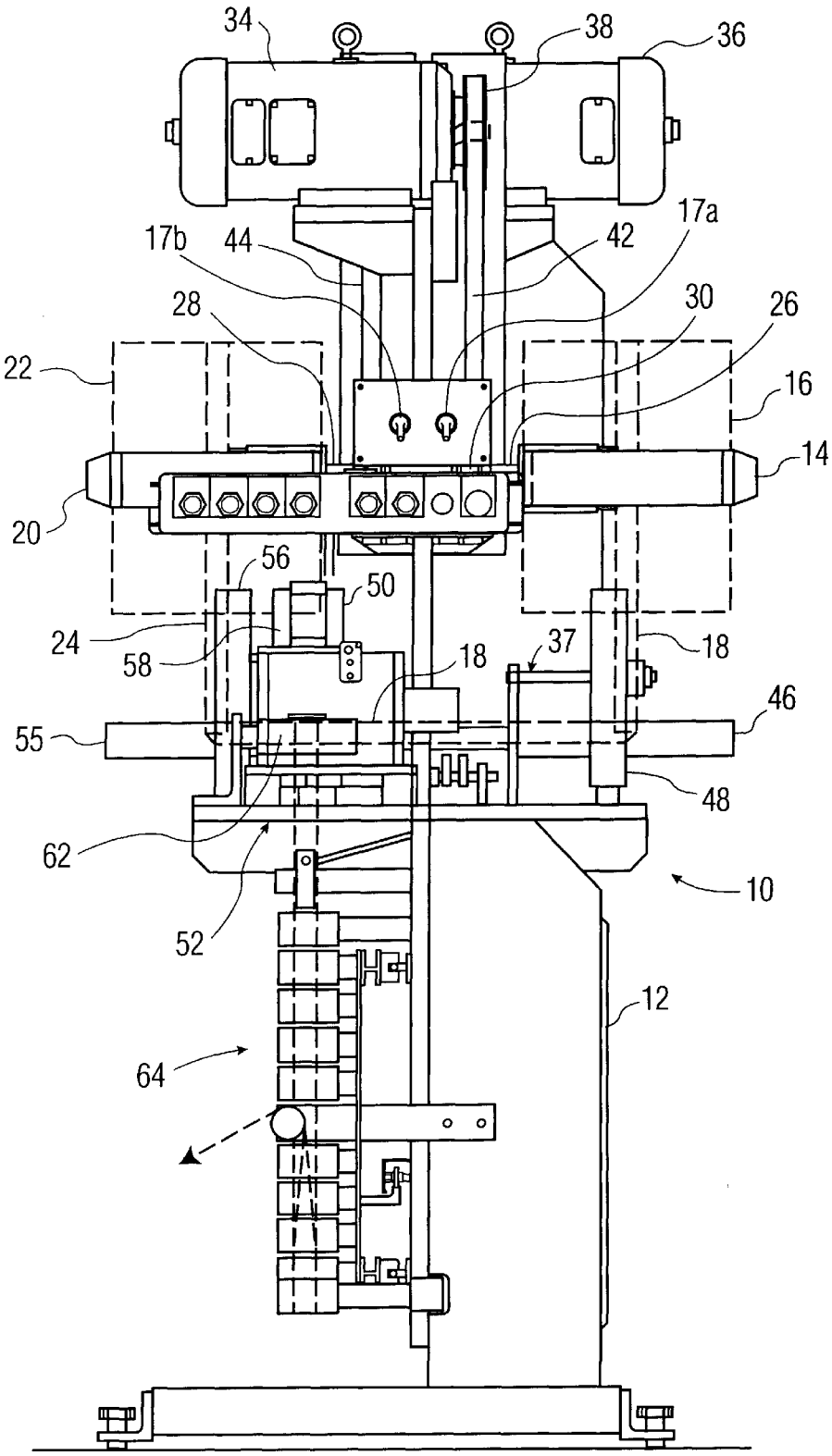
FIG. 1 is an exit side end elevational view of a lap splicing apparatus according to the present invention.
Figure 2:
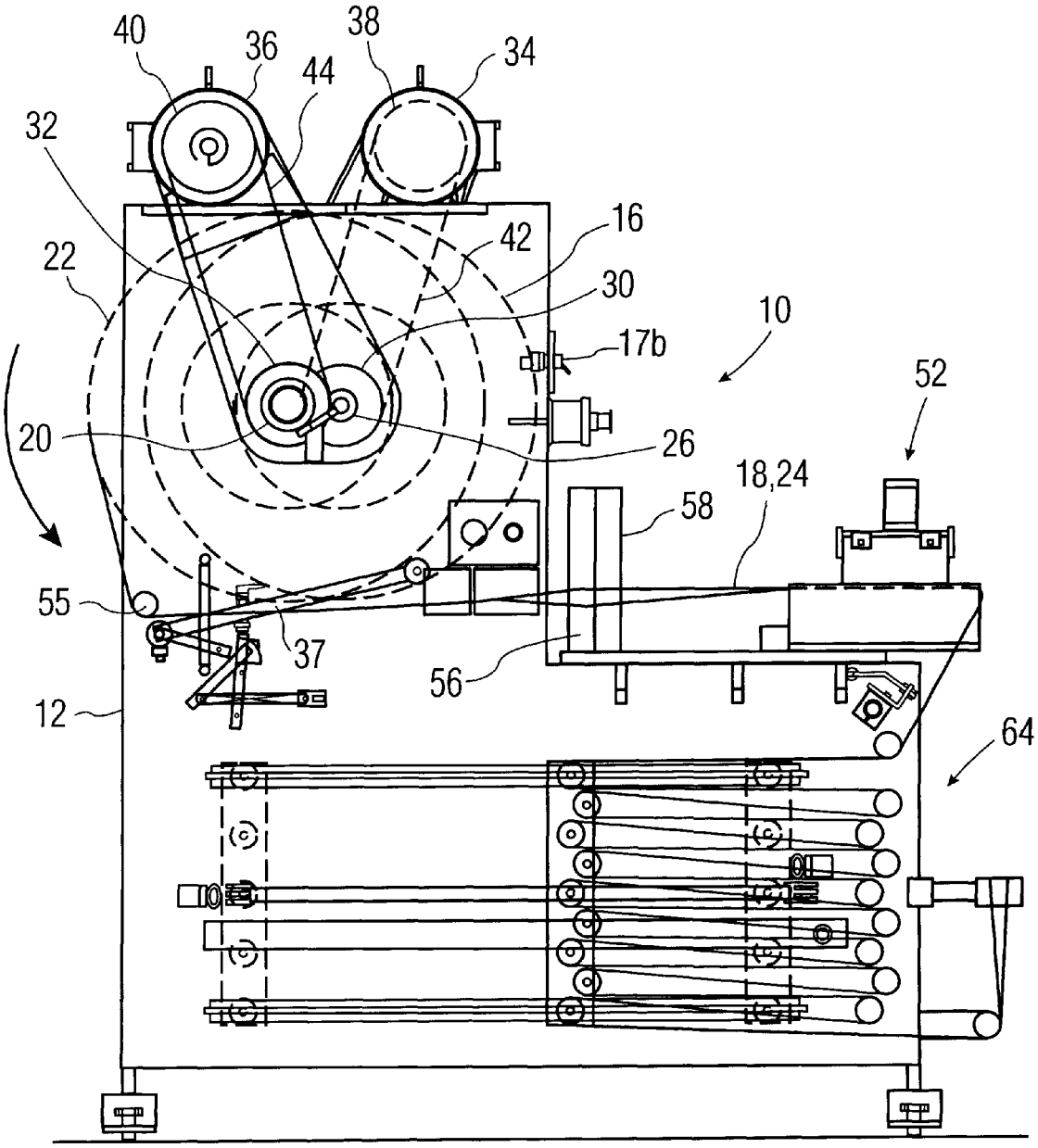
FIG. 2 is a side elevational view of the lap splicing apparatus.
Figure 3:
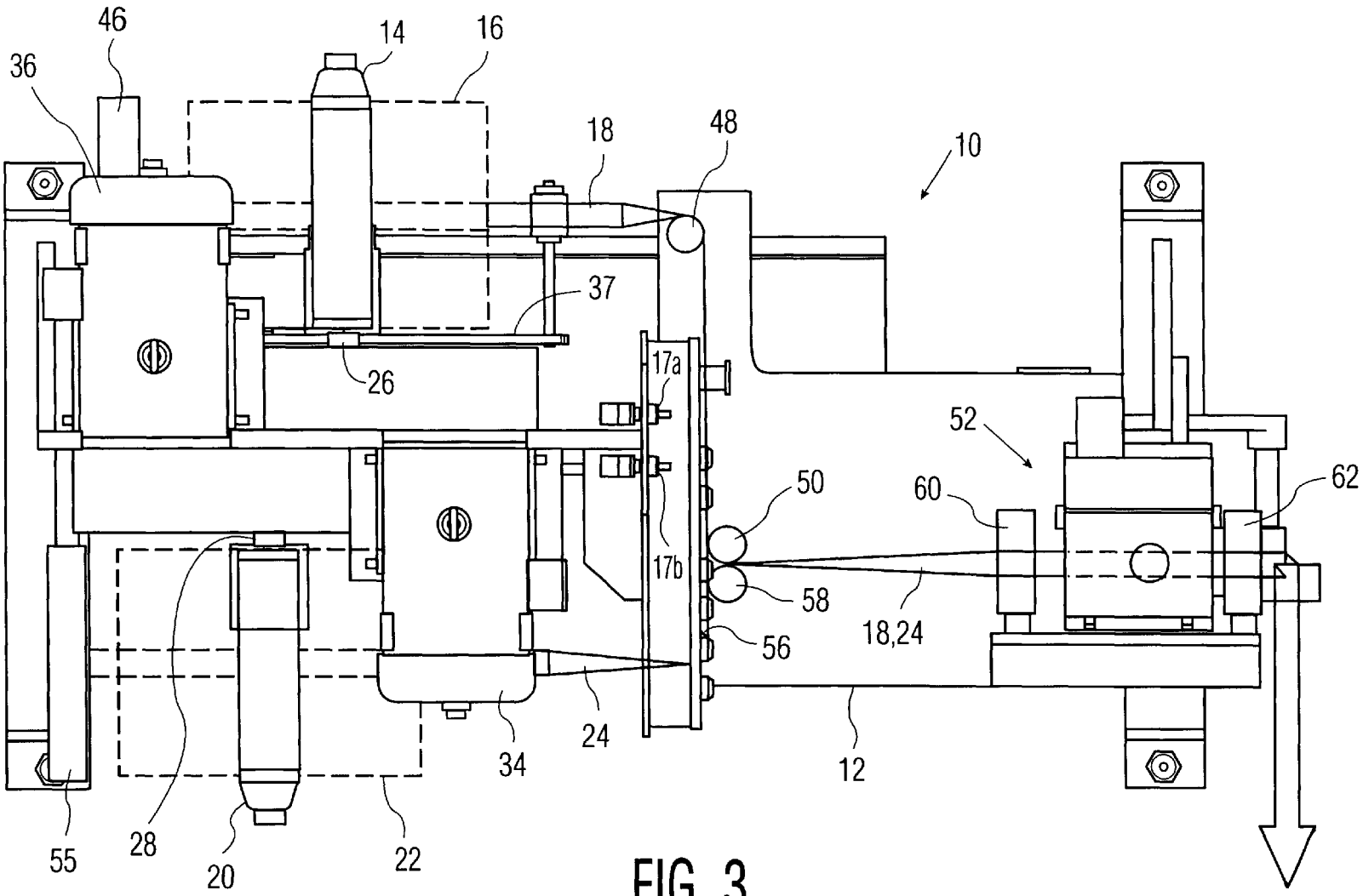
FIG. 3 is a top plan view of the lap splicing apparatus.

Referring to the drawings in detail, and initially to FIGS. 1–3, a lap splicing apparatus 10 according to the present invention includes a frame 12 having a first spindle 14 rotatably mounted at a first fixed position and containing a roll 16 with a first web 18 thereon. A second spindle 20 is rotatably mounted at a second fixed position on the opposite side of frame 12 for holding a roll 22 containing a second web 24 of material thereon. The web material with which the present invention is intended to be used is preferably a narrow width web material, as shown best in FIGS. 1 and 3, for example, in the range of approximately one to three inches, although the present invention is not limited thereby. Thus, the web material is preferably a narrow ribbon which can be easily turned in direction as will be understood from the description hereinafter.

First and second spindles 14 and 20 are rotatably mounted about parallel axes. Each spindle can include an air chuck or other arrangement for fixedly holding respective rolls 16 and 22 thereon, with apparatus 10 including air pressure ON/OFF switches 17*a* and 17*b* for activating and deactivating the air chucks of the respective spindles 14 and 20. Spindles 14 and 20 are mounted on rotatable shafts 26 and 28 having pulleys 30 and 32 mounted thereon. Drive motors 34 and 36 are mounted at the top of frame 12, with pulleys 38 and 40 mounted to the output shafts of drive motors 34 and 36. An endless belt 42 is wrapped about pulleys 30 and 38, and an endless belt 44 is wrapped about pulleys 32 and 40 such that drive motors 34 and 36 serve to rotate spindles 14 and 20 in order to feed or stop the webs to control tension thereon. Alternatively, a brake system can be used for the webs, as is well known, in place of the motor driven system.

A feeler arm 37 is provided in contact with the surface of each unwinding roll to detect when the roll nears depletion and a splice operation is to be performed. A switch (not shown) is then activated to start the splice operation.

First web 18 travels from roll 16 downwardly and around the underside of a horizontally oriented guide roller 46 to a vertically oriented guide roller 48 where first web 18 is rotated by 90° so as to pass around guide roller 48 and so as to be oriented in a vertical plane. From guide roller 48, first web 18 travels around a second vertically oriented guide roller 50. First web 18 is then rotated 90° again to be oriented in a horizontal plane and travels to a lap splice device 52 which will be described in more detail hereinafter.

In like manner, second web 24 travels downwardly and around the underside of a horizontally oriented guide roller 55, to and around a vertically oriented guide roller 56 so that it is rotated by 90° so as to be oriented in a vertical plane. From guide roller 56, second web 24 travels around a second vertically oriented guide roller 58, is then rotated by 90° where it is oriented in a horizontal plane, and travels to lap splice device 52. As shown best in FIG. 3, vertically oriented guide rollers 50 and 58 are close to one another. However, as will be understood from the description hereinafter, there is a spacing between guide rollers 50 and 58, and first and second webs 18 and 24 are arranged at different heights so as not to interfere with each other. Specifically, the running web 18 or 24 is at a lower position or level and extends over a horizontally oriented guide roller 60 where it passes through lap splice device 52 and then over another horizontally oriented guide roller 62 to a festoon or accumulator 64, which is well-known in the art and will not be described in detail hereinafter. Guide roller 60 is omitted from FIG. 2.

When either web is a new web to be spliced to the running web, the new web is provided at a higher position or level along roller 50 or 58, and is secured in lap splicing device 52 in a condition to be lap spliced to the trailing end of the running web upon depletion thereof.

As a modification, rollers 48, 50, 56 and 58 can be replaced by conventional right angle turn bars to change the orientation of the webs. In such case, wider webs can be used.

Figure 4:
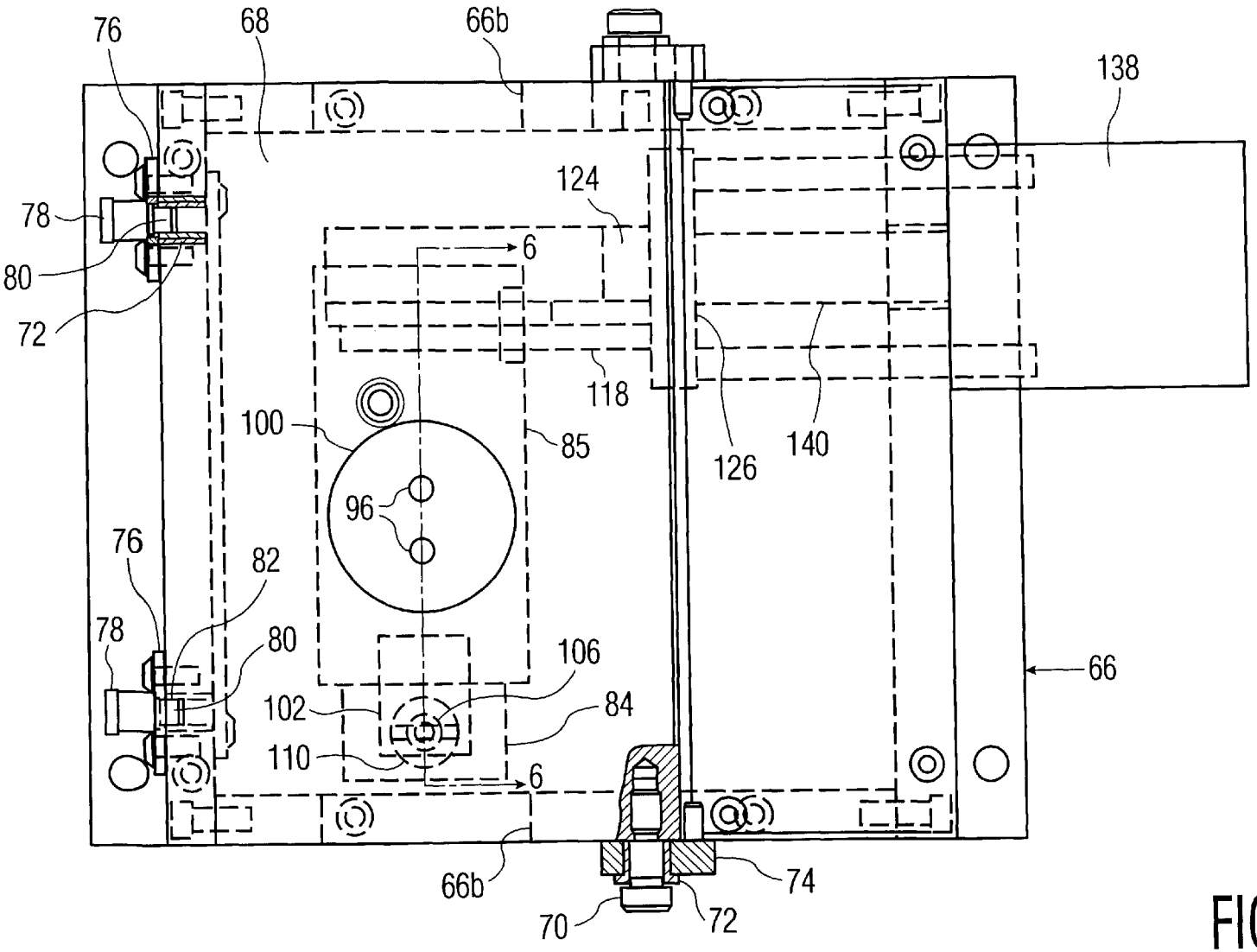
FIG. 4 is a top plan view of the lap splicing device of the lap splicing apparatus, partly in section.
Figure 5:
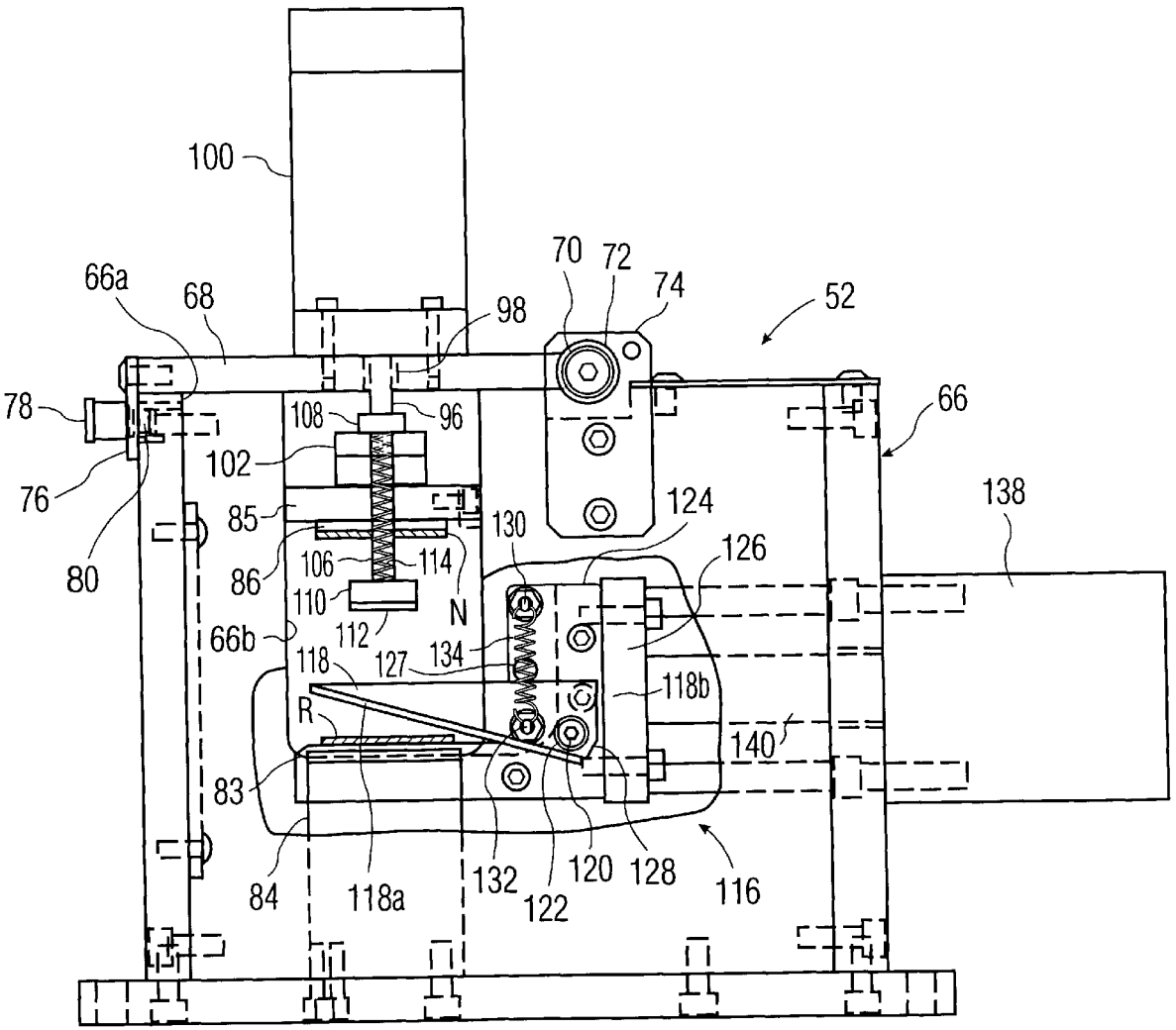
FIG. 5 is an exit side end elevational view of the lap splicing device, partly cut away.
Figure 6:
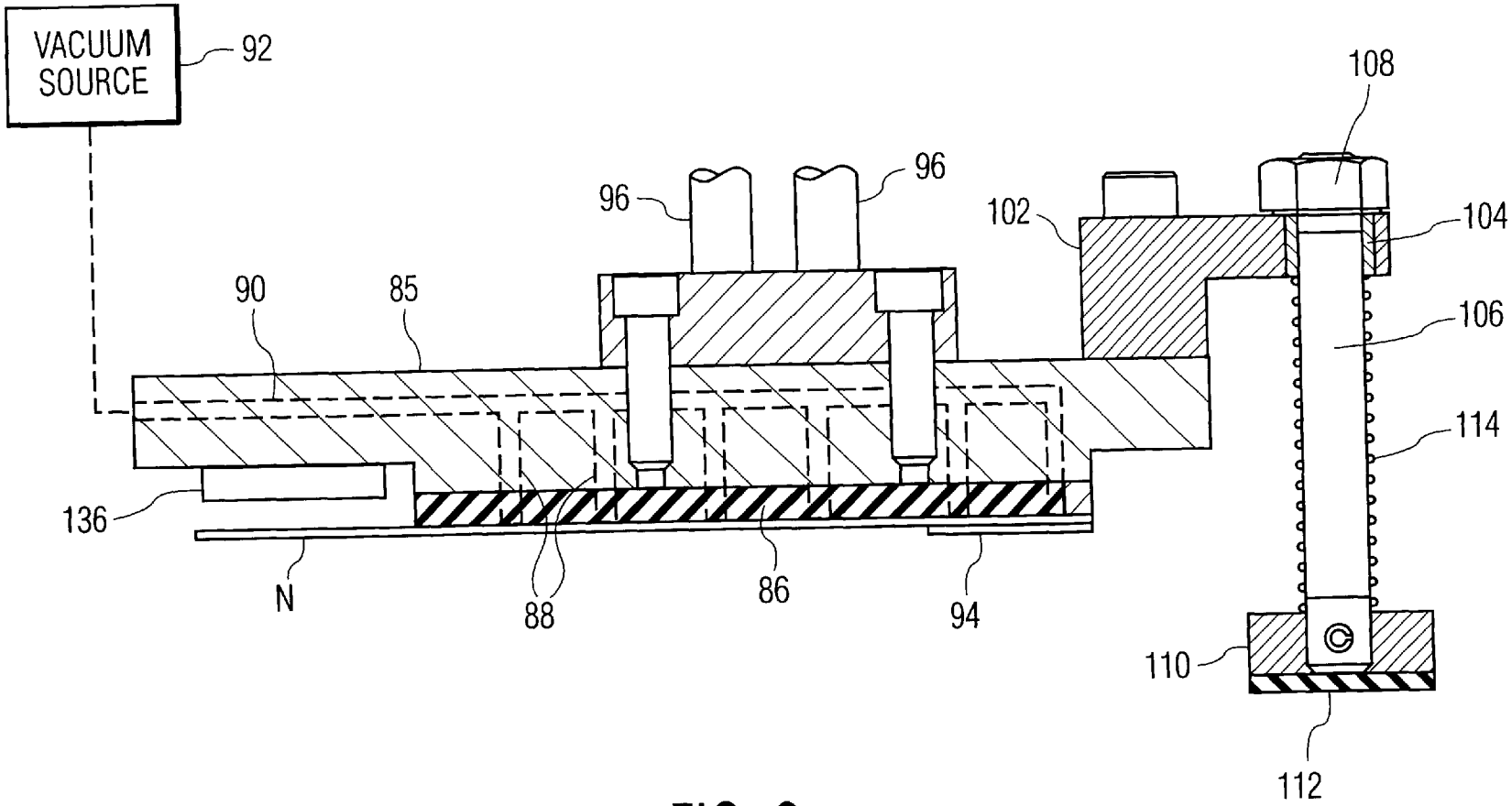
FIG. 6 is a cross-sectional view of the lap splicing device of FIG. 4, taken along line 6—6 thereof.

Referring now to FIGS. 4–6, a detailed description of lap splice device 52 will now be provided.

Lap splice device 52 includes a housing 66 which is open at opposite sides 66*b* thereof to permit webs 18 and 24 to pass therethrough and is also open at the upper end 66*a* thereof. A cover plate 68 is pivotally mounted at upper end 66*a* by opposite shoulder screws 70 mounted in flanged bearings 72 that are secured to pivot supports 74 at opposite sides at the upper end of housing 66. The opposite end of cover plate 68 is provided with two downwardly extending latch plates 76 at opposite sides thereof. Each latch plate 76 has a catch 78 mounted thereto with a spring loaded pin 80 engageable within a recess in a plain bearing 82 in a respective side of frame 66. In this manner, cover plate 68 can be latched in the closed position. Catches 78 can be pulled outwardly, that is, to the left in FIGS. 4 and 5 in order to remove pins 80 from bearings 82 against the force of the spring (not shown) therein, and thereby permit cover plate 68 to pivot about shoulder screws 70 to an open or raised position.

A splice block 84 having a rubber pad 83 on the upper surface thereof, is mounted to the bottom of housing 66 and is in alignment with side openings 66*b* of housing 66. The running web R, whether web 18 or 24, extends from horizontal guide roller 60, through one open side 66*b*, over the upper edge of rubber pad 83 of splice block 84 and through the opposite open side 66*b* to horizontal guide roller 62.

A new web holding assembly is mounted to cover plate 68. Specifically, a pressure plate 85 is movably supported at the underside of cover plate 68 and has a rubber pad 86 mounted to the underside thereof, with rubber pad 86 having similar dimensions to the upper surface of splice block 84. A plurality of vacuum holes 88 extend through pressure plate 85 and rubber pad 86 and are connected to a manifold 90 extending through pressure plate 85, with manifold 90 being connected to a vacuum source 92. In this manner, the leading end of a new web N, whether it be web 18 or 24, can be adhered by vacuum to the underside of rubber pad 86 for preparation in a lap splicing operation. Adhesive tape 94 can be secured to the leading end of new web N that is vacuum held to rubber pad 86. Alternatively, any other means for holding new web N to rubber pad 86 can be provided, such as clips, clamps, etc.

Pressure plate 85 is secured to lower ends of extension rods 96 that slidably extend through openings 98 in cover plate 68. Extension rods 96 form part of a non-rotating cylinder 100 that is mounted to the upper surface of cover plate 68. Accordingly, when extension rods 96 are extended from cylinder 100 so as to move downwardly in FIG. 5, they move pressure plate 85, and thereby new web N, into engagement with running web R in order to splice the webs together. At such time, adhesive tape 94 serves to adhere running web R and new web N together.

A clamp mount 102 is fixed to the exit end of pressure plate 85 and has an opening with a plain bearing 104 therein.

A clamp stud 106 slidably extends through plain bearing 104 with a stop nut 108 mounted to the upper end of clamp stud 106 to prevent escape of clamp stud 106 from plain bearing 104. A clamp pad 110 is fixed to the lower end of clamp stud 106, with a rubber pad 112 fixed to the underside of clamp pad 110. A compression spring 114 extends around clamp stud 106 and between the underside of clamp mount 102 and the upper surface of clamp pad 110 in order to normally bias clamp stud 106 downwardly to the position shown in FIG. 6. Thus, when pressure plate 85 moves downwardly, rubber pad 112 functions to clamp running web R to the upper surface of splice block 84 in order to prevent movement of running web R. Of course, downstream therefrom, running web R continues to run due to festoon 64. At this time, tape 94 can be adhered to running web R that is clamped with new web N, tape 94 and running web R being pressure sandwiched between rubber pad 83 of splice block 84 and rubber pad 86.

As will be appreciated, it is necessary to cut running web R so that, after the splice takes effect, new web N becomes the running web. In this regard, a cutting assembly 116 is provided in lap splice device 52. Specifically, a generally triangular shaped movable blade 118 having a lower cutting surface 118*a* is pivotally mounted by a shoulder screw 120 in a plain bearing 122 mounted to a blade fixing extension 124 of a plate 126. The lower portion of the right side edge 118*b* of blade 118, as viewed in FIG. 5, is cut away to provide an angled surface 128.

A spring anchor pin 130 is fixed to blade fixing extension 124 at a position above blade 118, and a second spring anchor pin 132 is fixed to a side surface of blade 118, with an extension spring 134 extending between pins 130 and 132 to bias blade 118 in the clockwise direction about shoulder screw 120 such that right side edge 118*b* of blade 118 is parallel with and in abutment with plate 126. A stop pin 127 is mounted to blade fixing extension 124 and against which the upper surface of blade 118 abuts, to limit the clockwise rotation of blade 118 to the position shown in FIG. 5.

When pressure plate 85 moves downwardly, a pusher plate 136 (FIG. 6) secured to the bottom of pressure plate 85, pushes down the upper surface of blade 118 so that blade 118 pivots in the counter-clockwise direction of FIG. 5 about shoulder screw 120 and cuts running web R. It will be appreciated that, during this time, new web N is positioned between pressure plate 136 and the upper surface of blade 118 but is not cut since the upper surface is not sharp. In addition, prior to the cutting operation, rubber pad 112 has already clamped running web R downstream from the cutting position.

After blade 118 has been rotated about shoulder screw 120 to perform the cutting operation, blade 118 is positioned below running web R and is retained in that position by pressure plate 136.

Upon continued downward movement of pressure plate 85, tape 94 is adhered to running web R. Then, pressure plate 85 is moved upwardly, whereby pressure pad 112 releases running web R so that running web R continues to be pulled into festoon 64. At this time, the new web N becomes the running web R. At the same time, knife blade 118 is rotated by spring 134 in the clockwise direction to the orientation shown in FIG. 5. Then, plate 126 is moved to the right in FIG. 5 by means of a cylinder 138 mounted to frame 66 and having an extension rod 140 connected with plate 126. After the new running web moves down onto splice block 84, extension rod 140 is moved to the left in FIG. 5 to again move knife blade 118 above the new running web R. Thus, movement of knife blade 118 to the right in FIG. 5 permits the new web N to move downwardly and become the new running web after a splice operation.

It will be appreciated that the new web N was positioned at a higher position or level on vertical guide roller 50 or 58 since it was secured to rubber pad 86 by a vacuum at a higher position immediately below cover plate 68. However, when new web N becomes the running web, it is moved down to the same position previously held by running web R so that it moves down to a lower level or position on vertical guide roller 50 or 58 and then becomes the new running web.

Thereafter, the deleted roll of the previous running web R is removed and replaced with a new roll which travels around the respective guide rollers at the higher position or level on the latter, and is then secured by vacuum to rubber pad 86.

Because of this arrangement, the new web N, regardless of whether it is formed by first web 18 or second web 24, is always at a higher position or level than the running web R and is then moved downwardly during a splicing operation to form the new running web which stays in the lower position or level. As a result, the tail of the running web R always remains on the same, lower side of the lap splice, regardless of whether first web 18 or second web 24 is the new web N or the running web R. Further, this is accomplished without any turret assembly and without moving the splice assembly between different orientations for the different webs.

Having described a specific preferred embodiment of the present invention with reference to the accompanying drawings, it will be appreciated that the present invention is not limited to that precise embodiment, and that various changes and modifications can be effected therein by one skilled in the art without departing from the scope or spirit of the invention as defined by the appended claims.

What is claimed is:

1. A lap splicing apparatus for lap splicing first and second webs together, with each of said first and second webs alternately constituting a running web and a new web to be spliced to the running web, said apparatus comprising:

a frame;

a first spindle mounted at a first fixed position on said frame for holding a roll containing the first web thereon;

a second spindle mounted at a second fixed position on said frame for holding a roll containing the second web thereon;

a single lap splicing device immovably mounted at a fixed position on said frame for lap splicing the first and second webs together with a trailing tail end of the lap splice always being on the same side;

a first transfer assembly mounted to the frame for bringing the first web to said lap splicing device, said first transfer assembly including at least one roller mounted to the frame for bringing the first web to said lap splicing device, said at least one roller being oriented to turn said first web by at least one angle, each roller of said first transfer assembly having a longitudinal axis about which the respective roller can be rotated and being fixed in position so as to be movable only for rotation along the respective longitudinal axis thereof; and a second transfer assembly mounted to the frame for bringing the second web to said lap splicing device, said second transfer assembly including at least one roller mounted to the frame for bringing the second web to said lag splicing device, said at least one roller of said second transfer assembly being oriented to turn said second web by at least one angle, each roller of said second transfer assembly having a longitudinal axis about which the respective roller can be rotated and being fixed in position so as to be movable only for rotation along the respective longitudinal axis thereof.

2. A lap splicing apparatus according to claim 1, wherein said single lap splicing device permits the running web to pass therethrough at a first level and includes:

a lap splicing device frame;

a holding device for holding a leading end of the new web;

a moving device at a fixed position on the lap splicing device frame for moving the holding device between a first lap splicing position and a second position at which no lap splicing occurs, with the new web being held at a different, second level spaced from the running web in the second position such that the second level remains the same regardless of whether the running web is the first web or the second web; and a cutting device for cutting the running web when the moving device moves the holding device to the first position to bring the new web into lap splicing contact with the running web during a lap splicing operation such that adhesive tape on the leading end of the new web adheres to the cut running web to lap splice the new web and the running web together, with the trailing tail end of the lap splice always being on the same side.

3. A lap splicing apparatus according to claim 2, wherein said holding device includes a pressure plate having a plurality of vacuum holes extending to an underside thereof, and a manifold for fluidly connecting a vacuum source with the vacuum holes to hold the new web to the underside of the pressure plate.

4. A lap splicing apparatus according to claim 2, wherein said lap splicing device further includes:

a splice block, and a clamping device for clamping the running web to the splice block to prevent movement thereof at the time of a lap splicing operation.

5. A lap splicing apparatus according to claim 2, wherein said moving device includes:

a cylinder fixed to the lap splicing device frame; and at least one rod which is extendable and retractable by said cylinder and connected to said holding device for moving said holding device toward and away from said running web.

6. A lap splicing apparatus according to claim 5, wherein said lap splicing device frame includes a pivotally mounted cover, and said cylinder is fixed to said cover to permit access to said holding device.

7. A lap splicing apparatus for lap splicing first and second webs together, with each of said first and second webs alternately constituting a running web and a new web to be spliced to the running web, said apparatus comprising:

a frame;

a first spindle mounted at a first fixed position on said frame for holding a roll containing the first web thereon;

a second spindle mounted at a second fixed position on said frame for holding a roll containing the second web thereon;

a single lap splicing device immovably mounted at a fixed position on said frame for lap splicing the first and second webs together with a trailing tail end of the lap splice always being on the same side, said single lap splicing device permitting the running web to pass therethrough at a first level and including:

a lap splicing device frame;

a holding device for holding a leading end of the new web;

a moving device at a fixed position on the lap splicing device frame for moving the holding device between a first lap splicing position and a second position at which no lap splicing occurs, with the new web being held at a different, second level spaced from the running web in the second position such that the second level remains the same regardless of whether the running web is the first web or the second web;

a cutting device for cutting the running web when the moving device moves the holding device to the first position to bring the new web into lay splicing contact with the running web during a lap splicing operation such that adhesive tape on the leading end of the new web adheres to the cut running web to lap splice the new web and the running web together, with the trailing tail end of the lap splice always being on the same side;

a splice block; and a clamping device for clamping the running web to the splice block to prevent movement thereof at the time of a lap splicing operation, said clamping device including a clamp stud slidably extending through said holding device and having a clamp pad at a lower end thereof for clamping the running web to the splice block;

a first transfer assembly mounted to the frame for bringing the first web to said lap splicing device; and a second transfer assembly mounted to the frame for bringing the second web to said lap splicing device.

8. A lap splicing apparatus according to claim 7, wherein said clamping device further includes a coil spring surrounding said clamp stud and positioned between said clamp pad and said holding device to bias said clamp pad in a direction toward said splice block.

9. A lap splicing apparatus for lap splicing first and second webs together, with each of said first and second webs alternately constituting a running web and a new web to be spliced to the running web, said apparatus comprising:

a frame;

a first spindle mounted at a first fixed position on said frame for holding a roll containing the first web thereon;

a second spindle mounted at a second fixed position on said frame for holding a roll containing the second web thereon;

a single lap splicing device immovably mounted at a fixed position on said frame for lap splicing the first and second webs together with a trailing tail end of the lap splice always being on the same side, said single lap splicing device permitting the running web to pass therethrough at a first level and including:

a lap splicing device frame;

a holding device for holding a leading end of the new web;

a moving device at a fixed position on the lap splicing device frame for moving the holding device between a first lap splicing position and a second position at which no lap splicing occurs, with the new web being held at a different, second level spaced from the running web in the second position such that the second level remains the same regardless of whether the running web is the first web or the second web: and a cutting device for cutting the running web when the moving device moves the holding device to the first position to bring the new web into lap splicing contact with the running web during a lap splicing operation such that adhesive tape on the leading end of the new web adheres to the cut running web to lap splice the new web and the running web together, with the trailing tail end of the lap splice always being on the same side, said cutting device including:

a knife blade pivotally mounted upstream of the holding device between a first pivoted position above the running web and a second pivoted position below the running web, such that the knife blade cuts the running web when moved from the first position to the second position;

an arrangement for holding the knife blade stably in the first position or the second position; and a second moving device for moving the knife blade transverse relative to the first moving device between a first transverse position in line with the running web and a second transverse position out of line with the running web;

a first transfer assembly mounted to the frame for bringing the first web to said lap splicing device; and a second transfer assembly mounted to the frame for bringing the second web to said lap splicing device.

10. A lap splicing apparatus according to claim 9, wherein said holding device impacts upon said knife blade when moving from the first position to the second position thereof to move the knife blade from the first pivoted position to the second pivoted position in order to cut the running web and thereby position said knife blade below said running web, and after the knife blade returns to the first pivoted position, thereafter, said second moving assembly moves said knife blade to said second transverse position so that said spliced new web can assume the position of the previous running web.

11. A lap splicing apparatus according to claim 10, wherein said arrangement for stably holding the knife blade in the first pivoted position includes a stop pin.

12. A lap splicing apparatus for lap splicing first and second webs together, with each of said first and second webs alternately constituting a running web and a new web to be spliced to the running web, said apparatus comprising:

a frame;

a first spindle mounted at a first fixed position on said frame for holding a first roll containing the first web thereon, such that said first web leaves said first roll at a first orientation;

a second spindle mounted at a second fixed position on said frame for holding a second roll containing the second web thereon, such that said second web leaves said second roll at said first orientation;

a single lap splicing device mounted on said frame for lap splicing the first and second webs together with a trailing tail end of the lap splice always being on the same side;

a first transfer assembly of rollers mounted to the frame for bringing the first web to said lap splicing device, said rollers of said first transfer assembly being oriented to turn said first web by at least one angle from said first orientation such that said first web is at a first level when constituting said running web and at a different, second level when constituting said new web prior to a lap splicing operation, with said new web moving from said second level to said first level after a lap splicing operation; and a second transfer assembly of rollers mounted to the frame for bringing the second web to said lap splicing device, said rollers of said second transfer assembly being oriented to turn said second web by at least one angle from said first orientation such that said second web is at said first level when constituting said running web and at said second level when constituting said new web prior to the lap splicing operation, with said new web moving from said second level to said first level after the lap splicing operation.

13. A lap splicing apparatus according to claim 12, wherein:

said first and second spindles are mounted along first and second axes, said first transfer assembly includes a first guide roller having an axis substantially transverse to the axis of said first spindle for rotating the orientation of the first web by substantially 90° from said first orientation to a second orientation, and said lap splicing device rotates said first web back to said first orientation, said second transfer assembly includes a second guide roller mounted to the frame and having an axis substantially transverse to the axis of the second spindle for rotating the orientation of the second web by substantially 90° from said first orientation to said second orientation, and said lap splice device changes the orientation of said second web back to said first orientation.

14. A lap splicing apparatus according to claim 13, wherein said first transfer assembly includes a third guide roller having an axis substantially parallel to the axis of said first guide roller and interposed between said first guide roller and said lap splicing device to maintain the orientation of said first web at said second orientation, but to change the direction of movement of said first web.

15. A lap splicing apparatus according to claim 13, further including a downstream guide roller having an axis substantially parallel to the axes of said first and second spindles and interposed between said first and second transfer assemblies and said lap splicing device to guide the webs in said first orientation.

16. A lap splicing apparatus according to claim 13, wherein said axes of said first and second spindles are horizontal axes and said first orientation is a substantially horizontal orientation, and the axes of said first and second guide rollers are substantially vertical axes and the orientation of the web at said first and second guide rollers is a substantially vertical orientation.

17. A lap splicing apparatus for lap splicing first and second webs together, with each of said first and second webs alternately constituting a running web and a new web to be spliced to the running web, said apparatus comprising:

a frame;

a first spindle mounted at a first fixed position on said frame for holding a roll containing the first web thereon, such that said first web leaves said first roll at a first orientation;

a second spindle mounted at a second fixed position on said frame for holding a roll containing the second web thereon, such that said second web leaves said second roll at said first orientation;

a single lap splicing device immovably mounted at a fixed position on said frame for lap splicing the first and second webs together with a trailing tail end of the lap splice always being on the same side;

a first transfer assembly of rollers mounted to the frame for bringing the first web to said lap splicing device, said rollers of said first transfer assembly being oriented to turn said first web by at least one angle from said first orientation such that said first web is at a first level when constituting said running web and at a different, second level when constituting said new web prior to a lap splicing operation, with said new web moving from said second level to said first level after a lap splicing operation; and a second transfer assembly of rollers mounted to the frame for bringing the second web to said lap splicing device, said rollers of said second transfer assembly being oriented to turn said second web by at least one angle from said first orientation such that said second web is at said first level when constituting said running web and at said second level when constituting said new web prior to the lap splicing operation, with said new web moving from said second level to said first level after the lap splicing operation.

18. A lap splicing apparatus according to claim 17, wherein said single lap splicing device permits the running web to pass therethrough at a first level and includes:

a lap splicing device frame;

a holding device for holding a leading end of the new web;

a moving device at a fixed position on the lap splicing device frame for moving the holding device between a first lap splicing position and a second position at which no lap splicing occurs, with the new web being held at a different, second level spaced from the running web in the second position such that the second level remains the same regardless of whether the running web is the first web or the second web; and a cutting device for cutting the running web when the moving device moves the holding device to the first position to bring the new web into lap splicing contact with the running web during a lap splicing operation such that adhesive tape on the leading end of the new web adheres to the cut running web to lap splice the new web and the running web together, with the trailing tail end of the lap splice always being on the same side.

19. A lap splicing apparatus according to claim 18, wherein said holding device includes a pressure plate having a plurality of vacuum holes extending to an underside thereof, and a manifold for fluidly connecting a vacuum source with the vacuum holes to hold the new web to the underside of the pressure plate.

20. A lap splicing apparatus according to claim 18, wherein said lap splicing device further includes:

a splice block, and a clamping device for clamping the running web to the splice block to prevent movement thereof at the time of a lap splicing operation.

21. A lap splicing apparatus according to claim 20, wherein said clamping device includes a clamp stud slidably extending through said pressure plate and having a clamp pad at a lower end thereof for clamping the running web to the splice block.

22. A lap splicing apparatus according to claim 21, wherein said clamping device further includes a coil spring surrounding said clamp stud and positioned between said clamp pad and said pressure plate to bias said clamp pad in a direction toward said splice block.

23. A lap splicing apparatus according to claim 18, wherein said moving device includes:

a cylinder fixed to the lap splicing device frame; and at least one rod which is extendable and retractable by said cylinder and connected to said holding device for moving said holding device toward and away from said running web.

24. A lap splicing apparatus according to claim 23, wherein said lap splicing device frame includes a pivotally mounted cover, and said cylinder is fixed to said cover to permit access to said holding device.

25. A lap splicing apparatus according to claim 18, wherein said cutting device includes:

a knife blade pivotally mounted upstream of the holding device between a first pivoted position above the running web and a second pivoted position below the running web, such that the knife blade cuts the running web when moved from the first position to the second position;

an arrangement for holding the knife blade stably in the first position or the second position; and a second moving device for moving the knife blade transverse relative to the first moving device between a first transverse position in line with the running web and a second transverse position out of line with the running web.

26. A lap splicing apparatus according to claim 25, wherein said holding device impacts upon said knife blade when moving from the first position to the second position thereof to move the knife blade from the first pivoted position to the second pivoted position in order to cut the running web and thereby position said knife blade below said running web, and after the knife blade returns to the first pivoted position thereafter, said second moving assembly moves said knife blade to said second transverse position so that said spliced new web can assume the position of the previous running web.

27. A lap splicing apparatus according to claim 26, wherein said arrangement for stably holding the knife blade in the first pivoted position includes a stop pin.

28. A lap splicing apparatus according to claim 17, wherein:

said first and second spindles are mounted along first and second axes, said first transfer assembly includes a first guide roller having an axis substantially transverse to the axis of said first spindle for rotating the orientation of the first web by substantially 90° from said first orientation to a second orientation, and said lap splicing device rotates said first web back to said first orientation, said second transfer assembly includes a second guide roller mounted to the frame and having an axis substantially transverse to the axis of the second spindle for rotating the orientation of the second web by substantially 90° from said first orientation to said second orientation, and said lap splice device changes the orientation of said second web back to said orientation.

29. A lap splicing apparatus according to claim 28, wherein said first transfer assembly includes a third guide roller having an axis substantially parallel to the axis of said first guide roller and interposed between said first guide roller and said lap splicing device to maintain the orientation of said first web at said second orientation, but to change the direction of movement of said first web.

30. A lap splicing apparatus according to claim 28, further including a downstream guide roller having an axis substantially parallel to the axes of said first and second spindles and interposed between said first and second transfer assemblies and said lap splicing device to guide the webs in said first orientation.

31. A lap splicing apparatus according to claim 28, wherein said axes of said first and second spindles are horizontal axes and said first orientation is a substantially horizontal orientation, and the axes of said first and second guide rollers are substantially vertical axes and the orientation of the web at said first and second guide rollers is a substantially vertical orientation.

* * * * *